US006234826B1

(12) United States Patent
Wilber et al.

(10) Patent No.: US 6,234,826 B1
(45) Date of Patent: May 22, 2001

(54) CONNECTOR POSITION ASSURANCE DEVICE

(75) Inventors: Darrin F. Wilber, Metamora; Robert J. Flowers, Ortonville, both of MI (US)

(73) Assignee: Cardell Corporation, Auburn Hills, MI (US)

( * ) Notice: Subject to any disclaimer, the term of this patent is extended or adjusted under 35 U.S.C. 154(b) by 0 days.

(21) Appl. No.: 09/302,992

(22) Filed: Apr. 30, 1999

(51) Int. Cl.[7] ..... H01R 13/627
(52) U.S. Cl. ..... 439/352; 439/489
(58) Field of Search ..... 439/489, 488, 439/352–358, 350

(56) References Cited

U.S. PATENT DOCUMENTS

| | | | |
|---|---|---|---|
| 4,370,013 | 1/1983 | Niitsu et al. . | |
| 4,634,204 | 1/1987 | Detter et al. . | |
| 4,971,580 | 11/1990 | Ward et al. . | |
| 4,984,998 | 1/1991 | Duncan et al. . | |
| 5,120,255 | 6/1992 | Kouda et al. . | |
| 5,217,390 | 6/1993 | Nozaki et al. . | |
| 5,234,356 | 8/1993 | Maejima et al. . | |
| 5,370,543 | 12/1994 | Hamada et al. . | |
| 5,507,666 | 4/1996 | Yamanashi . | |
| 5,522,740 | 6/1996 | Plocek et al. . | |
| 5,573,430 | 11/1996 | Hatagishi . | |
| 5,605,472 | 2/1997 | Sakai et al. . | |
| 5,628,648 | 5/1997 | Higgins, Jr. et al. . | |
| 5,681,178 | 10/1997 | Kunkle et al. . | |
| 5,700,163 | 12/1997 | Okabe . | |
| 5,720,623 | 2/1998 | Polenick et al. . | |
| 5,759,058 | 6/1998 | Childs et al. . | |
| 5,839,915 | 11/1998 | Ford et al. . | |
| 5,910,027 * | 6/1999 | Wayt et al. | 439/489 |
| 6,012,945 * | 1/2000 | Tabor et al. | 439/489 |
| 6,012,946 * | 1/2000 | Fukase | 439/489 |
| 6,045,388 * | 4/2000 | Higgins et al. | 439/352 |

* cited by examiner

*Primary Examiner*—Kheim Nguyen
(74) *Attorney, Agent, or Firm*—Jones, Tullar & Cooper, PC

(57) ABSTRACT

A connector includes a first housing half and a second housing half, with one of the connector halves being a socket half, and the other connector half being a plug half. A latching mechanism is provided so that when the connector halves are assembled, they are latched together in the assembled position. A CPA device is also provided which is independent of the connector halves. The CPA device may be securely mounted on one of the connector halves prior to assembly of the connector halves. Following latching of the connector halves into the assembled condition, the CPA device may be slid forward to a final position to lock the latching mechanism to prevent the connector from being inadvertently unlatched. Also, if the connector halves are not fully and properly assembled, it is not possible to slide the CPA device into the final position. Additionally, after the CPA device is seated in its final position, the two connector halves cannot be disconnected from each other unless the CPA device is manually slid back to the initial or "ready" position. However, in order to disassemble the connector, the CPA device must be manually disengaged from the final locked position, and moved to the initial unlocked position, before the latch may be manually unlatched so that the connector halves may be unmated.

20 Claims, 6 Drawing Sheets

CONNECTOR POSITION ASSURANCE DEVICE

BACKGROUND OF THE INVENTION

1. Field of the Invention

The present invention generally relates to an electrical connector system, and, more particularly, to a connector position assurance device for assuring proper connection and providing secure latching when connecting two halves of an electrical connector.

2. Description of the Prior Art

An electrical connector typically includes a pair of connector housing components or halves constructed from a dielectric material. The housing halves are usually identified as a plug half (or male half) and a socket half (also referred to as the receptacle half or female half). The two halves have complementary inter-engaging conductive terminals for completing an electrical circuit when the housing halves are fully and properly mated. The plug half generally has one or more projecting conductive pins which are inserted into one or more conductive receptacles or sockets on the socket half. The contact between the pins and sockets forms the electrical connection between the two connector halves.

Electrical connectors normally require a secure mechanical and electrical engagement between the two connector halves. Some prior art connectors rely only on friction to hold the connector halves together, and are relatively easy to separate or unmate, thereby disconnecting the electrical circuit. Obviously, inadvertent separation of a connector may cause malfunction of the equipment and associated inconvenience, safety concerns, or the like.

To prevent unintentional separation of the connector halves, a latching means is often included with the connector housing for holding the male and female connector halves in the engaged position. The latching means may also include a locking means to retain the connector in the latched position and to provide assurance to a person assembling the connector that the connector has been properly assembled, latched, and locked, and that the electrical connection is therefore complete. Such locking and indicating mechanisms are known in the art as connector position assurance ("CPA") devices. A CPA device may be separate from the latching mechanism, or may be integrated as part of the latch. Typically, the primary function of a CPA device is to indicate that the connector halves are fully mated and latched. A secondary function is often to prevent the latching mechanism from inadvertently unlatching, so that the connector halves will not separate. Thus, CPA devices provide visual and mechanical assurance of the relative positions of the connector components, and thereby verify the complete mating of the components.

Latching mechanisms incorporating CPA devices have been accomplished in a wide variety of ways in the prior art. For example, U.S. Pat. No. 5,759,058, to Jonathan Childs, assigned to the same assignee as in the present application, discloses an electrical connector having two connector halves, with a latching mechanism and a CPA device. The latching mechanism includes a flexible arm on a first connector half and a shoulder on a second connector half. As the connector halves are assembled, the flexible arm engages with the shoulder for latching the connector halves together. Following latching of the connector halves, a CPA device may then be slid forward and snapped into a final locked position. In this position, the CPA device prevents the flexible latching arm from disengaging from the shoulder, and, accordingly, the connector halves may not be unlatched.

Further, if the connector halves are not properly mated, the CPA device is not able to slide into its proper forward position, thereby giving an indication of improper assembly of the connector halves.

Other prior art patents have described a wide variety of CPA devices. For example, U.S. Pat. No. 5,120,255, to T. Kouda, et al., discloses a connector position assurance component for utilization with a connector in which either the plug half or the socket half incorporates a tabbed latch. This tabbed latch pushes down on the CPA component during mating of the first connector half to the second connector half, thereby freeing the CPA component and allowing it to be moved manually into its final position.

The prior art also discloses a connector having a lock-release-prevention device which includes a flexible arm having a projection which causes the arm to bend as the connector halves are assembled. This moves the end of the flexible arm to prevent a sliding portion from locking into a final position if the connector halves are not properly assembled. Other prior patents show electrical connectors having a locking arm that is pivotally connected, or having a locking arm with a resilient bar, with a CPA device which slides or locks into place after the two connector halves are properly mated.

While the foregoing latch and CPA mechanisms function effectively for their intended applications, the components can be relatively bulky. The components are typically molded from plastic, and, thus, must be sufficiently thick to perform their intended function without cracking or breaking, while still being able to flex during assembly. Accordingly, it is desirable to provide an alternative latch and CPA mechanism whose functional components enable a lower profile and more compact construction than those of the prior art, without sacrificing strength and functionality. The latching mechanism and CPA device of the present invention provide these and other benefits, and overcome the shortcomings associated with the prior art.

SUMMARY OF THE INVENTION

In the preferred form of the invention, a connector includes a first housing half and a second housing half, with one of the connector halves being a socket half, and the other connector half being a plug half. A latching mechanism is provided so that as the connector halves are assembled, they are latched together in the assembled position. A CPA device is also provided which is independent of the connector halves. The CPA device may be securely mounted on one of the connector halves prior to assembly of the connector halves. Following latching of the connector halves into the assembled condition, the CPA device may be slid forward to a final position to lock the latching mechanism to prevent the assembled connector from being inadvertently unlatched. Also, if the connector halves are not fully and properly assembled, it is not possible to slide the CPA device into the final position. Additionally, after the CPA device is seated in its final position, the two connector halves cannot be unlatched from each other unless the CPA device is manually slid back to the initial or "ready" position. However, in order to disassemble the connector, the CPA device must be manually disengaged from the final locked position and moved to the initial unlocked position before the latch may be manually unlatched so that the connector halves may be unmated.

The CPA device of the present invention comprises a molded plastic component including a generally planar body having two forwardly extending basically parallel legs located in generally the same plane as the planar body. The legs are generally mirror images of each other, and each leg includes a dogleg segment along a mid portion of the leg and a flat stub area on the distal tip. The tips of the legs are beveled to facilitate insertion of the CPA device into guide channels located on one of the connector half housings. Each leg tip further includes a convex engagement area on the outer side of the tip for engagement with release projections on the other connector half. Each leg further includes a locking surface adjacent to the dogleg area for holding the CPA device in the final position once the CPA device has been slid forward. Also, when the CPA device is mounted on the connector housing in the initial ready position, this locking surface engages with a portion of the connector housing for securely mounting the CPA device on the connector housing.

The CPA device further includes a push pad which projects upward from the planar body for use in manually pushing against the CPA device with a thumb, finger, or the like, to insert and slide forward the CPA device. Also, a latch restraint projects upward from the planar body adjacent to the push pad. The latch restraint is centrally located on the planar body and extends perpendicular to the push pad. When the CPA device is in the final position, the latch restraint is located under a portion of the latch mechanism, and prevents the connector latch from being unlatched.

The CPA device may be mounted on the first connector half prior to assembly of the first connector half to the second connector half. The first connector half includes a pair of parallel guide channels for receiving the legs of the CPA device. When mounting the CPA device on the first connector half, the legs of the CPA device are inserted into the guide channels. The CPA device then may be slid forward and snapped into the initial ready position as the locking surfaces of the legs exit the forward ends of the guide channels and the locking surfaces spring slightly outward to engage with the forward ends of the guide channels. This engagement between the locking surfaces and the forward ends of the guide channels prevents easy withdrawal of the CPA device from its ready position once it is mounted on the first connector half. Also, the stub surfaces on the tips of the legs will contact raised lugs projecting upward from the surface of the first connector half housing. The contact between the stub surfaces and the raised lugs prevents further forward movement of the CPA device prior to assembly of the connector halves.

When the first connector half is assembled to the second connector half, disengagement projections on the second connector half contact the convex engagement surfaces on the tips of the CPA legs, forcing the legs inward. This disengages the stub surfaces from the raised lugs, and the CPA device may then be slid forward to its final position. However, if the second connector half is not completely mated to the first connector half, then the disengagement projections do not contact the legs of the CPA device, and the stub surfaces remain engaged with the raised lugs on the first connector half, thereby preventing the CPA device from being moved to its final position.

The first connector half further includes a latching mechanism which engages with the second connector half upon mating to latch the two connector halves together. In the preferred embodiment described, the latch mechanism includes a reverse-cantilevered latch arm located on the exterior of the first connector half, and the latch arm has an aperture formed therein. A ramped, tooth-like latch projection extends downward from the second connector housing and, when the connector halves are assembled, the latch projection enters into the aperture on the cantilevered latch arm. A perpendicular surface on the rear side of the latch projection prevents the connector halves from being pulled apart following assembly. The latch arm must be depressed to disengage the latch projection from the aperture in the latch arm to allow unmating of the connector halves. However, when the CPA device is in the final position, the latch arm cannot be depressed because the CPA latch restraint is located directly under the latch arm. Accordingly, so long as the CPA device is in the final forward position, the connector halves cannot be unlatched.

Thus, the present invention provides a low profile, compact, reliable, and ergonomic latching and CPA mechanism for use with an electrical connector or the like. Furthermore, while the preferred embodiment of the invention is described in conjunction with the latching mechanism for a particular two-part electrical connector for a wiring harness or the like, it may be equally well used with other latchable devices, and is not limited to use with electrical connectors or the particular latch configuration shown.

BRIEF DESCRIPTION OF THE DRAWINGS

The foregoing and additional objects, features, and advantages of the present invention will become apparent to those of skill in the art from a consideration of the it following detailed description of a preferred embodiment of the invention, taken in conjunction with the accompanying drawings.

DETAILED DESCRIPTION

Figure 1:
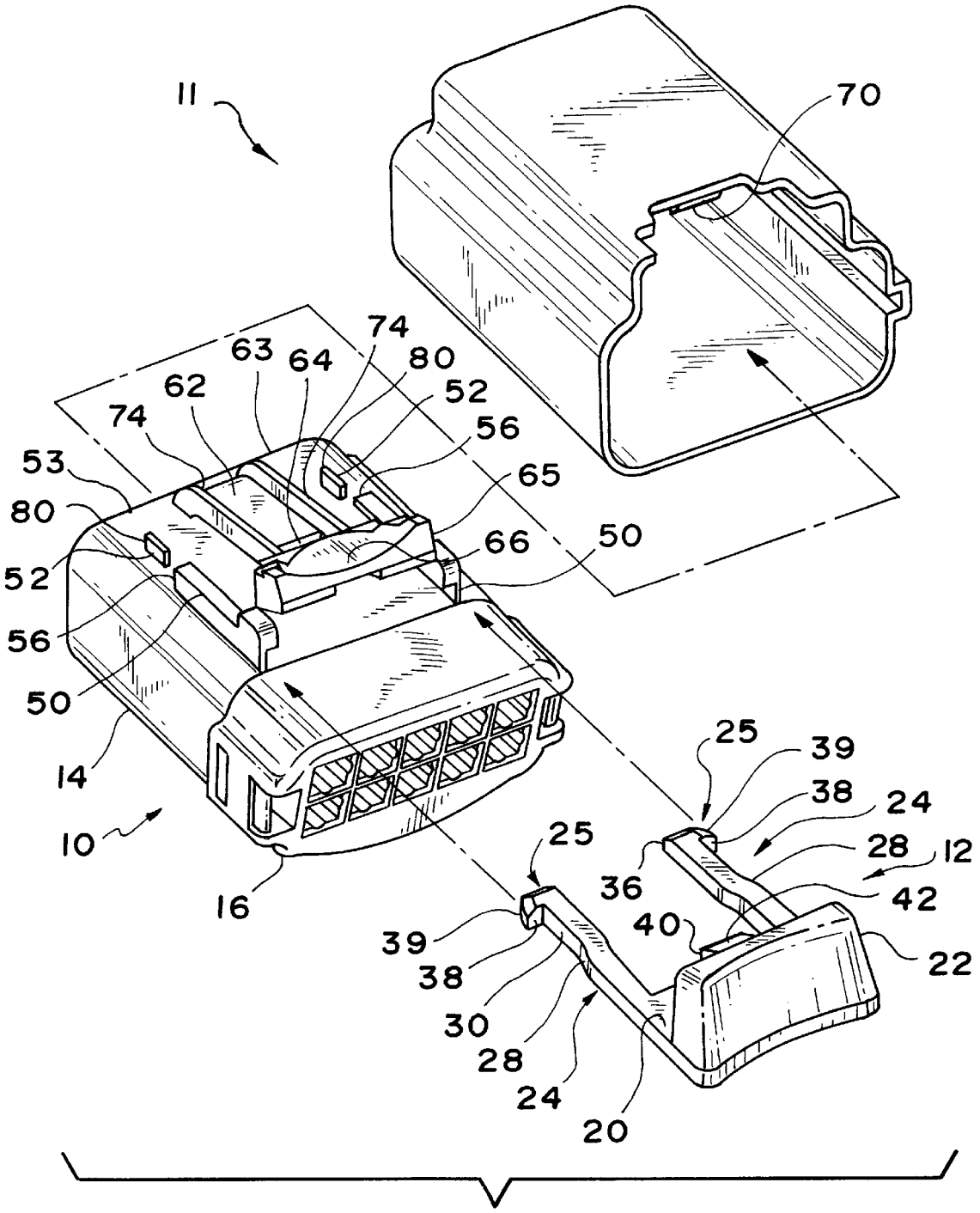
FIG. 1 is a perspective view of two halves of an electrical connector and a CPA device in accordance with the preferred embodiment of the present invention.
Figure 2A:
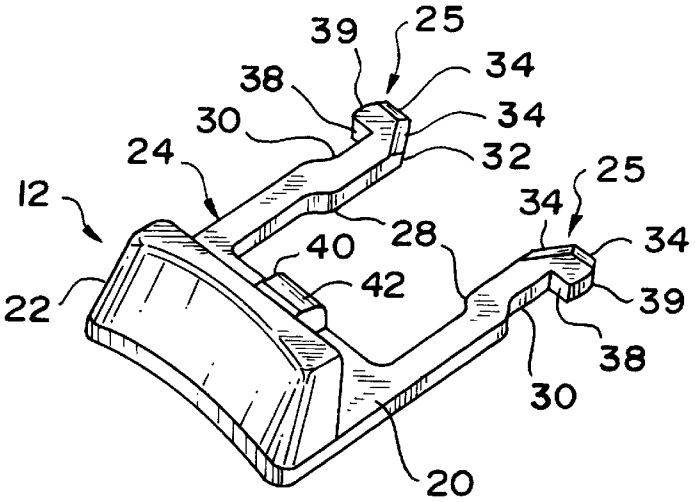
FIG. 2*a* is an enlarged reverse-angle perspective view of the CPA device of FIG. 1.
Figure 2B:
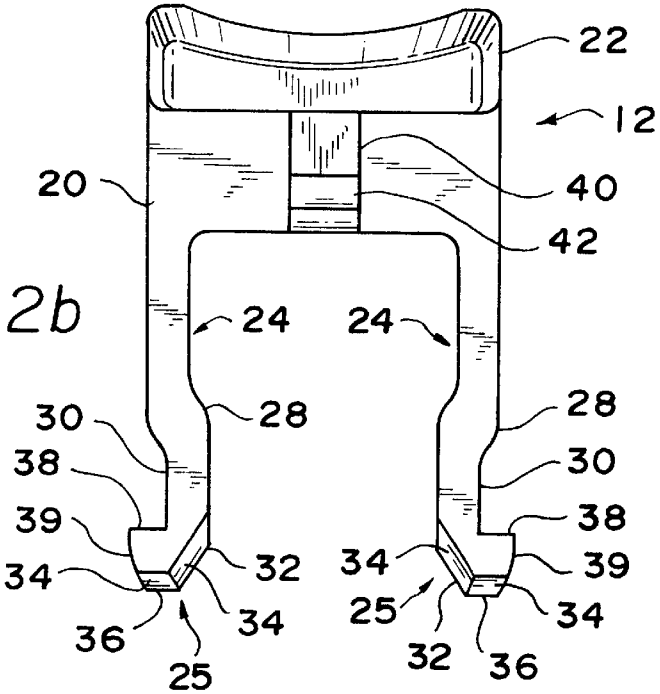
FIG. 2*b* is an enlarged plan view of the CPA device of FIG. 2*a*.
Figure 2D:
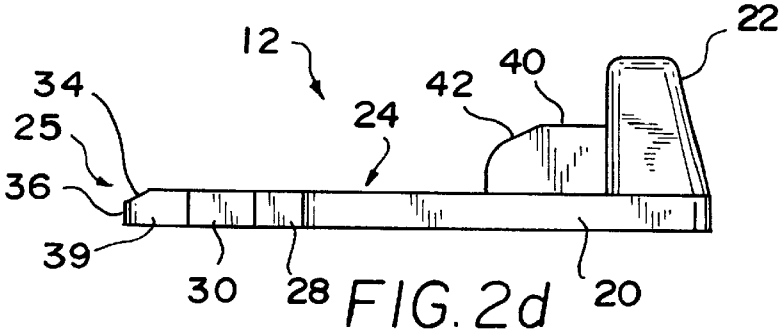
FIG. 2*d* is a side view of the CPA device of FIG. 2*c*.
Figure 2C:
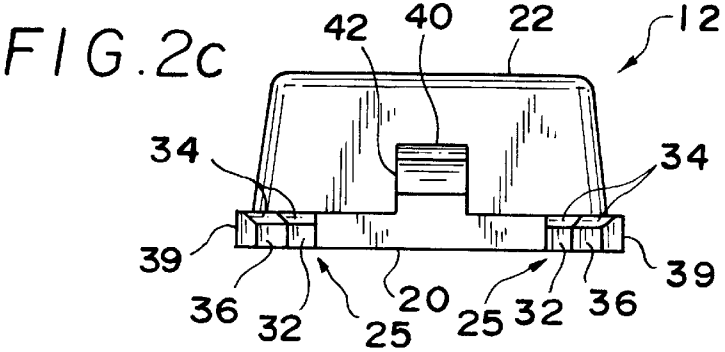
FIG. 2*c* is a front view of the CPA device of FIG. 2*b*
Figures 3A, 3B, 3C, 3D, 3E:
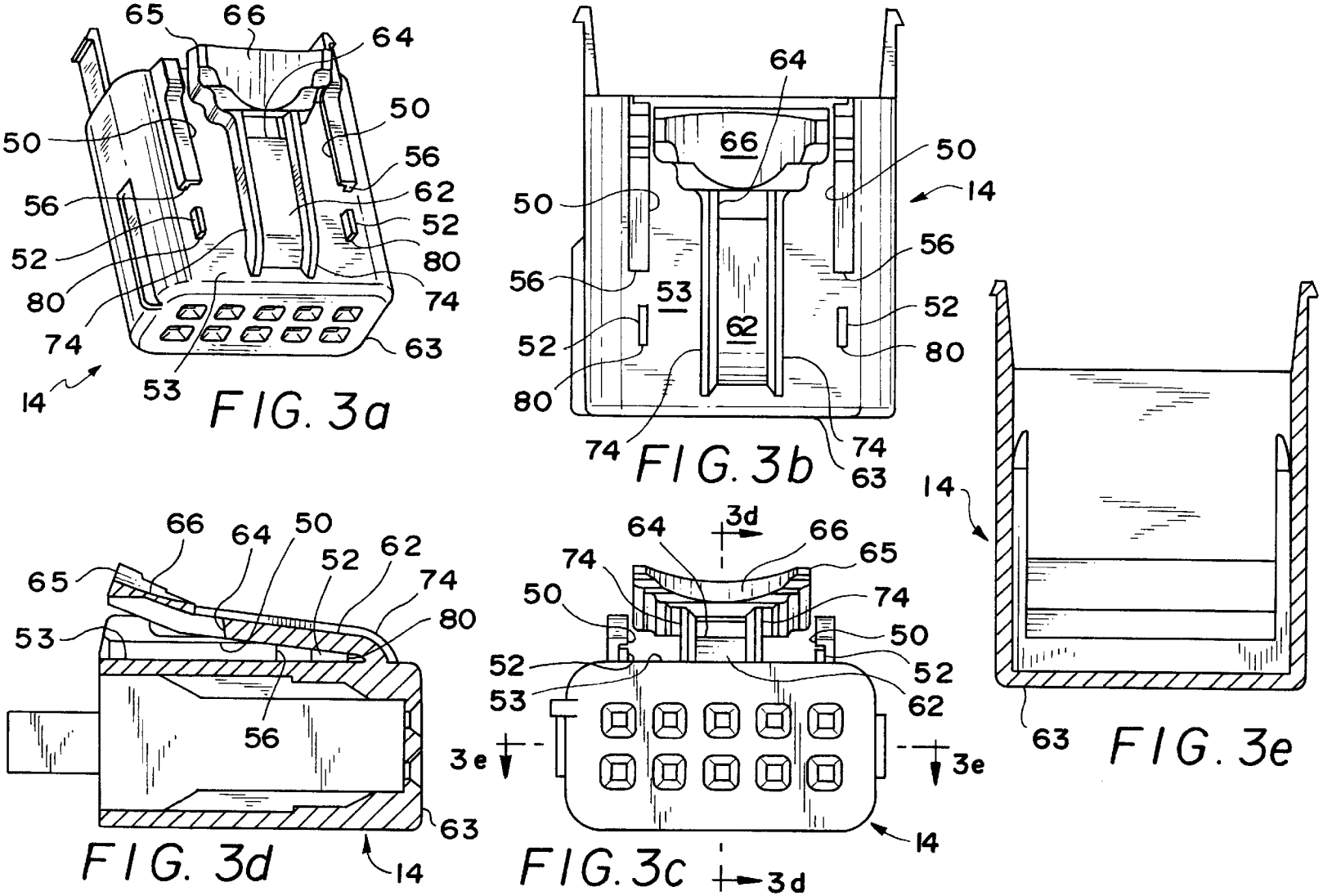
FIG. 3*a* is a reduced-scale perspective view of the first connector half of FIG. 1, with the insert portion of the connector removed.
FIG. 3*b* is an enlarged plan view of the first connector half of FIG. 3*a*.
FIG. 3*c* is a front view of the first connector half of FIG. 3*b*.
FIG. 3*d* is a cross sectional view of the first connector half of FIG. 3*c*, as taken along line 3*d*—3*d*.
FIG. 3*e* is a cross sectional view of the first connector half of FIG. 3*c*, as taken along line 3*e*—3*e*.
Figure 5A:
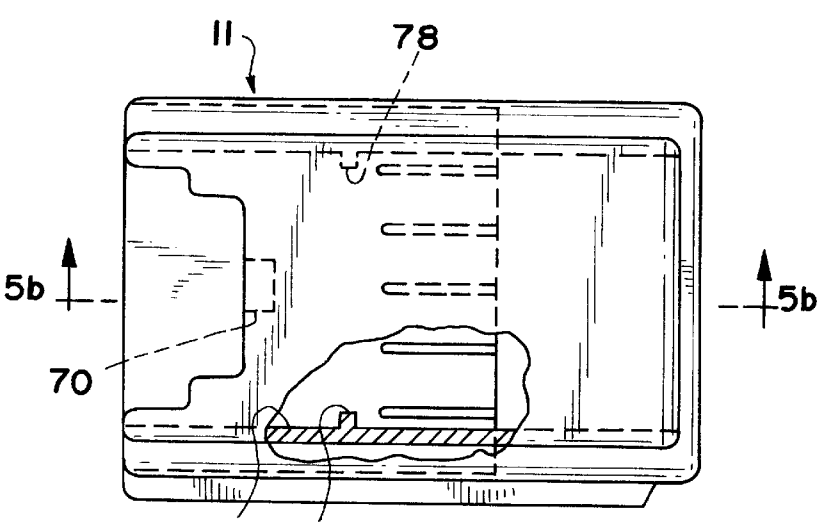
FIG. 5*a* is a plan view of the second connector half of the invention.
Figure 5B:
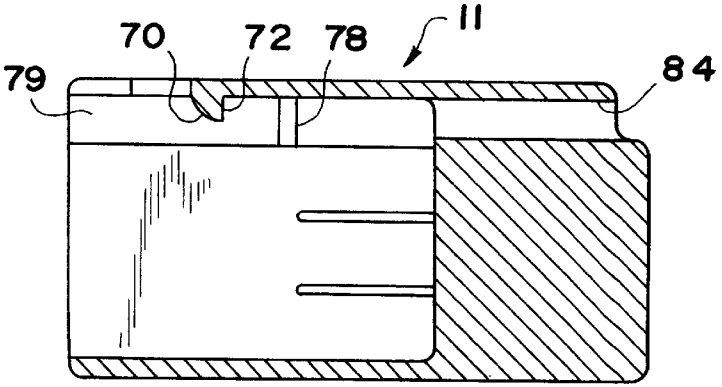
FIG. 5*b* is a cross-sectional view of the second connector half of FIG. 5*a*, as taken along line 5*b*—5*b*.

Turning now to a more detailed description of the present invention, there is illustrated in FIG. 1 an electrical connector including a first connector half 10 a second connector half 11, and a CPA device 12 in accordance with the present invention. First connector half 10 is illustrated as a socket half of a connector and second connector half 11 is illustrated as a plug half of the connector, but these configurations could easily be reversed. First connector half 10 is illustrated as a two-piece connector half, and includes a connector housing 14 and a connector insert 16. Connector housing 14 and connector insert 16 are designed so that insert 16 fits within housing 14 to facilitate installation of socket terminals (not shown). First connector half 10 may be inserted into second connector half 11 for forming an electrical connection.

First connector half 10 is described in more detail in applicants' co-pending patent application entitled "Electrical Connector Having a Two-Piece Socket Portion", filed on an even date herewith, to the same inventors as herein, to the same assignee as herein, under attorney docket no. WILB-US1, U.S. Pat. Appl. No. TBA, and the disclosure of which is incorporated herein by reference. It will be apparent however, that CPA device 12 may be used with any appropriately patterned connector, or configured for any intended connector application, and, thus, the particular configuration of connector half 10 is not critical to the invention so long as the proper features are included on the connector housing surface, as set forth below. Accordingly, the invention may be used with any type of interfitting connectors, and the invention is not limited to the particular arrangement shown.

As illustrated in FIGS. 2*a*–2*d*, CPA device 12 includes a generally planar body portion 20. A contoured push pad 22 extends generally perpendicularly upward from planar body 20 for enabling a user to manually push CPA device 12 from an initial position to a final position during installation and use of CPA device 12. A pair of legs 24 extend forward from planar body 20, generally in the same plane as planar body 20. Legs 24 are basically mirror images of each other, and extend distally of planar body 20 generally parallel to each other. Each leg 24 includes a dogleg segment 28 which creates an indented area 30 whose purpose will be explained in more detail below. The distal tip 25 of each leg 24 also includes a vertically-formed inner bevel 32 and a pair of obliquely formed forward bevels 34. Bevels 32, 34 facilitate insertion of CPA device 12 into first connector half 10. Each leg 24 further includes a flat stub surface 36 on its distal end and a flat lock surface 38, opposite to stub surface 36, and within indented area 30. The tip 25 of each leg 24 also includes a convexly-curved engagement area 39 which is adjacent to stub surface 36, and which interfaces with a mating connector half during assembly of the connector, as described in more detail below.

CPA device 12 also includes a generally rectangular latch restraint 40 which is centrally located on planar body 20, and which extends generally perpendicularly upward from planar body 20, adjacent and perpendicular to push pad 22. Latch restraint 40 includes a ramped latch engagement surface 42 which engages with a latch mechanism, as described below, on first connector half 10 to prevent the latch from being unlatched to disassemble a mated connector. Also, it will be apparent that CPA device 12 may be constructed of any suitable material, but is preferably a molded thermoplastic having sufficient flexibility to allow the distal tips 25 of legs 24 to flex inward toward each other and return to their original configuration.

CPA device 12 may be mounted on first connector half 10 prior to assembly of first connector half 10 to second connector half 11. First connector half 10 includes housing portion 14 and insert portion 16 which also may be constructed of any suitable material, but preferably are constructed of a dielectric thermoplastic so that injection molding may be used for manufacturing. FIGS. 3*a*–3*e* illustrate housing 14 with insert 16 removed. Housing 14 includes a pair of parallel guide channels 50 for receiving legs 24 of CPA device 12 when CPA device 12 is mounted on first connector half 10. Located distally of each guide channel 50 is a rectangular raised lug 52 which projects upward from the surface 53 of connector housing 14. Raised lugs 52 engage with stub surfaces 36 on CPA device 12 for preventing forward movement of CPA device 12 prior to assembly of first connector half 10 to second connector half 11.

Figure 4A:
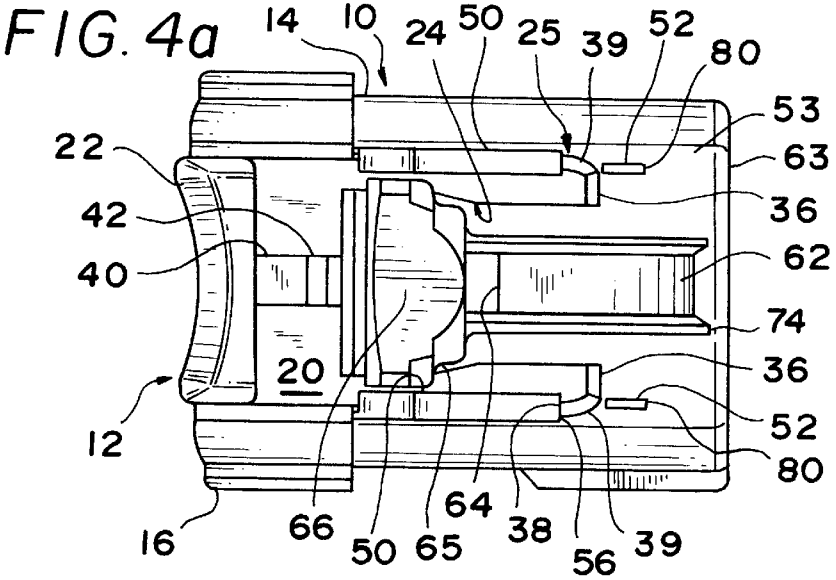
FIG. 4*a* is a plan view of the first connector half of FIG. 1, with the CPA device of the invention installed in the initial or "ready" position.
Figure 4B:
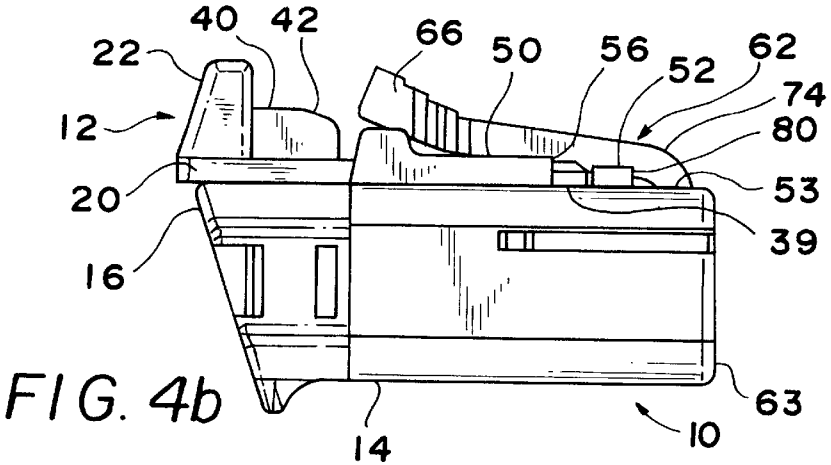
FIG. 4*b* is a side view of the first connector half and CPA device of FIG. 4*a*.

To load CPA device 12 onto first connector half 10, and into the ready position, as illustrated in FIGS. 4*a* and 4*b*, legs 24 are inserted into guide channels 50. The distance between guide channels 50 is slightly less that the width between the outside edges of convex engagement areas 39 on CPA legs 24. Thus, as CPA device 12 is slid forward in guide channels 50, CPA device 12 will snap into position as locking surfaces 38 of legs 24 exit from guide channels 50 and engage with the forward ends 56 of guide channels 50. The interface of locking surfaces 38 with forward ends 56 of guide channels 50 prevents CPA device 12 from being withdrawn from channels 50. In addition, as CPA device 12 is pushed forward, stub surfaces 36 on the tips 25 of legs 24 contact raised lugs 52. Raised lugs 52 prevent further forward movement of CPA device 12. Thus, CPA device is securely mounted in the initial ready position, and may be so retained in this position on first connector half 10 until assembly of the connector halves 10, 11.

Accordingly, CPA device 12 may be mounted on first connector half 10 at any time prior to assembly of first connector half 10 to second connector half 11. Alternatively, CPA device 12 may be installed on first connector half 10 following assembly of first connector half 10 to second connector half 11. Also, for the particular configuration illustrated, CPA device 12 may be installed on housing 14 prior to insertion of insert 16 into housing 14, or after insertion of insert 16 into housing 14. Thus, CPA device 12 may be installed early in the assembly process, and is securely retained on first connector half 10 in a position ready for use. Any number of pre-assembly steps may be performed with CPA device 12 installed in the ready position. Then, following assembly of first connector half 10 to second connector half 11, stub surfaces 36 are disengaged from raised lugs 52, as will be described below, and CPA device 12 may be moved from the ready position to the final locked position.

First connector half 10 further includes a latching mechanism 60 which engages with second connector half 11 upon assembly to latch together the two connector halves 10, 11. In the preferred embodiment described, latch mechanism 60 includes a centrallylocated reverse-cantilevered latch arm 62 which extends rearward from the mating end 63 of connector half 10. Latch arm 62 has a latching aperture 64 formed through it near the free end 65 of arm 62. Latch arm 62 is preferably molded contiguously with housing 14, and is resilient in nature so that the free end 65 may be depressed toward surface 53 of housing 14 and then spring back to its initial position. Latch arm 62 further includes a finger pad 66 formed on its free end 65 to facilitate depression of latch arm 62, using a finger or the like, when unlatching first connector half 10 from second connector half 11.

As illustrated in FIGS. 5*a*, 5*b*, 6*a*, 6*b*, 7*a* and 7*b*, second connector half 11 includes a tooth-like ramped latch projection 70 which extends downward from second connector half 11. During assembly of first connector half 10 to second connector half 11, ramped latch projection 70 rides up latch arm 62 and enters into aperture 64. The inherent resilience of latch arm 62 causes latch projection 70 to snap into aperture 64 and be retained therein. Also, latch arm 62 may include side flanges 74 formed along its length. Side flanges 74 act as guides for latch projection 70 during assembly, and also increase the stiffness of latch arm 62. A perpendicular surface 72 on the rear side of latch projection 70 engages with the edge of aperture 64 and prevents the connector halves 10, 11 from being pulled apart following assembly. Latch arm 62 must be depressed to disengage aperture 64 from latch projection 70 for enabling disassembly of connector halves 10, 11.

Figure 6A:
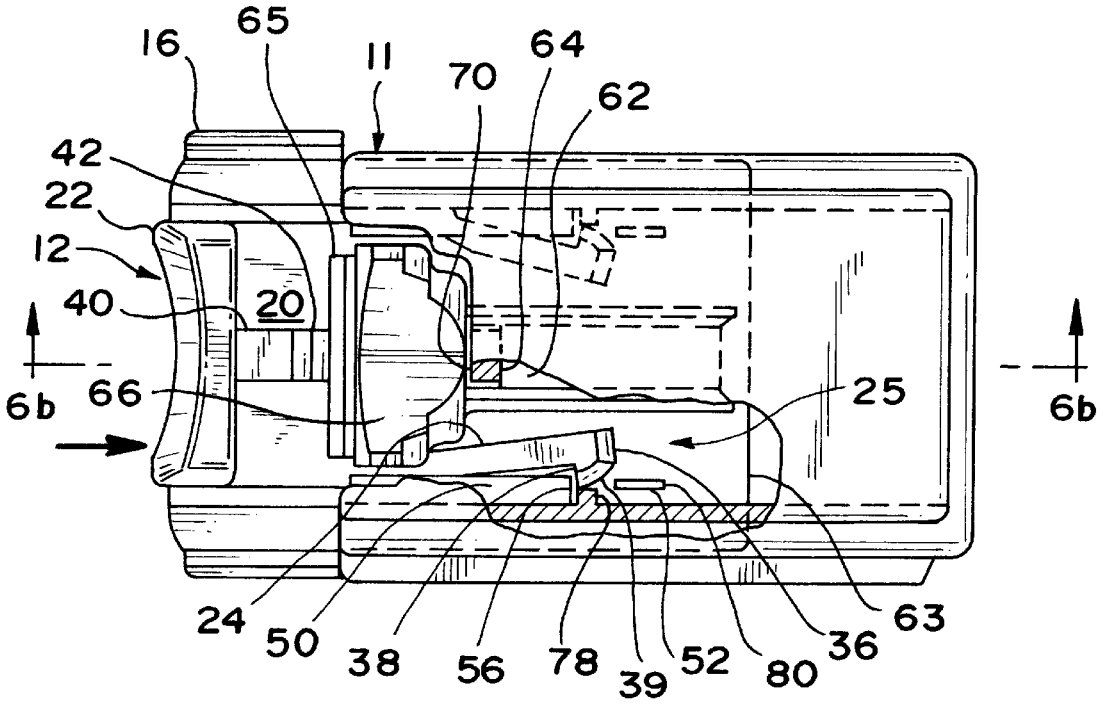
FIG. 6*a* is a plan view showing the first connector half assembled to the second connector half, and with the CPA device still in the initial position.
Figure 6B:
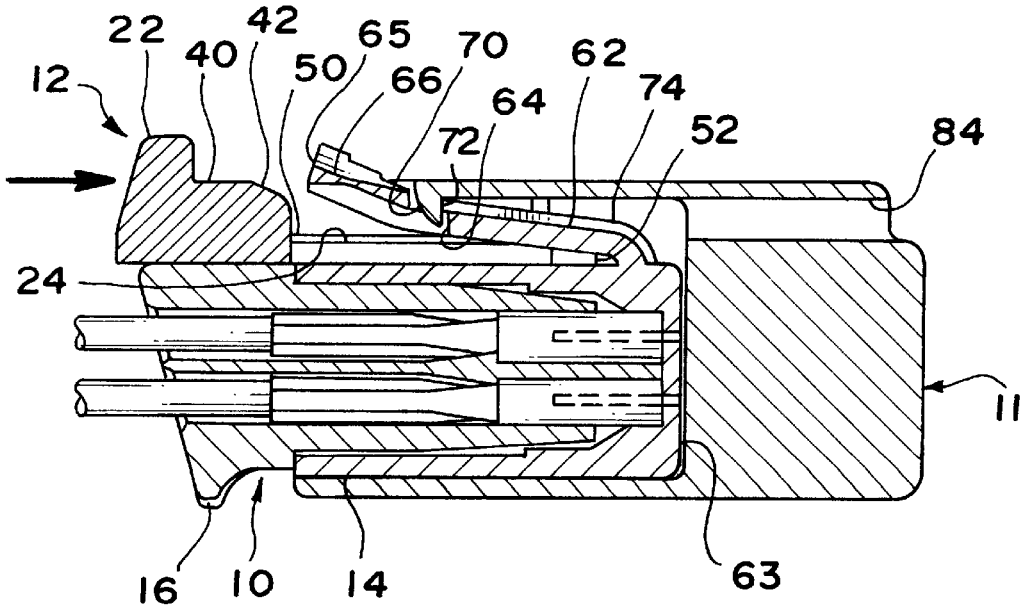
FIG. 6*b* is a cross-sectional view of the assembly illustrated in FIG. 6*a*, as taken along line 6*b*—6*b*.
Figure 7A:
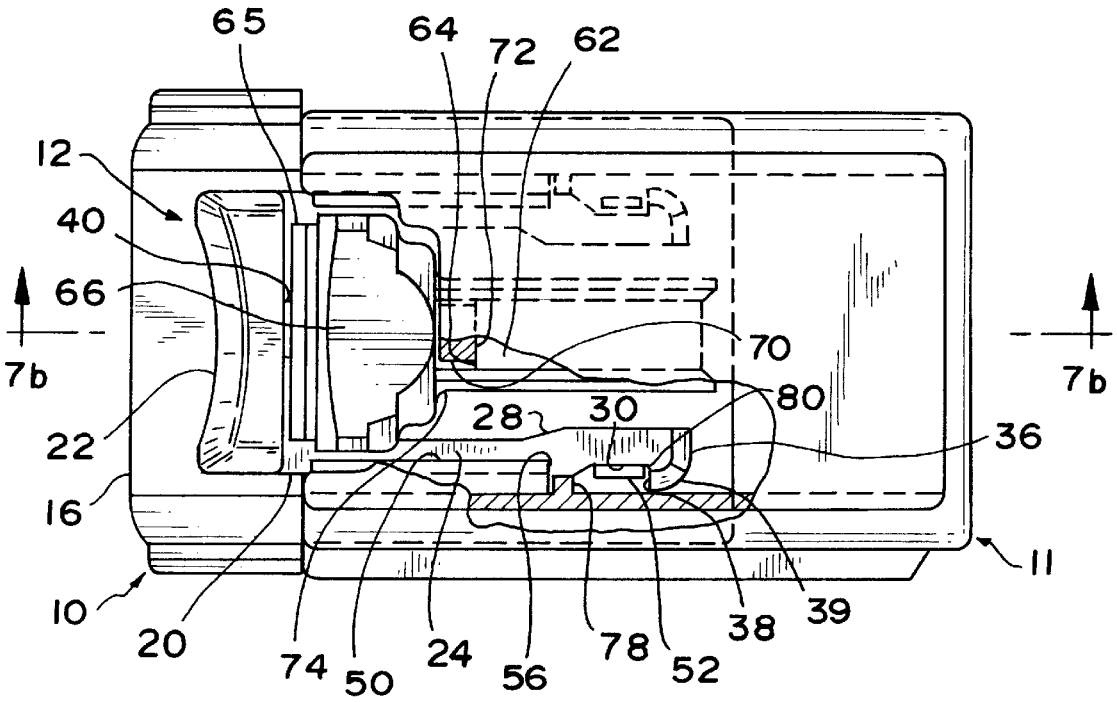
FIG. 7*a* is a plan view of the assembly of FIG. 6*a*, illustrating the CPA device moved to the final position.
Figure 7B:
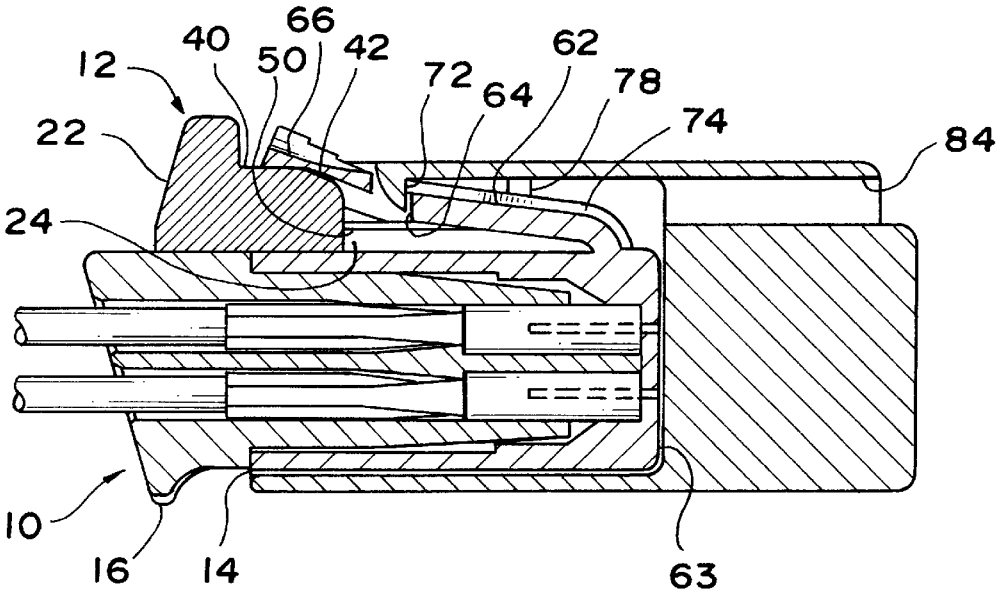
FIG. 7*b* is a cross-sectional view of the assembly illustrated in FIG. 7*a*, as taken along line 7*b*—7*b*.

Second connector half 11 further includes a pair of disengagement projections 78 located on its inside surface 79. As illustrated in FIG. 6*a*, when first connector half 10 is assembled to second connector half 11, disengagement projections 78 on second connector half 11 are located between lugs 52 and the forward ends 56 of guide channels 50. In this position, disengagement projections 78 contact the convexly-curved engagement areas 39 on the tips 25 of CPA legs 24. When second connector half 11 is fully mated with first connector half 10, disengagement projections 78 forced legs 24 to flex inward, as illustrated in FIGS. 6*a* and 6*b*. This disengages stub surfaces 36 from contact with raised lugs 52, and CPA device 12 may then be pushed forward to its final position, as illustrated in FIGS. 7*a* and 7*b*. However, if second connector half 11 is not completely mated to first connector half 10, then disengagement projections 78 do not contact CPA legs 24, and stub surfaces 36 remain engaged with raised lugs 52, thereby preventing CPA device 12 from being moved to its final position.

Furthermore, as illustrated in FIG. 7*a*, when CPA device 12 is moved to the final full forward and locked position, lugs 52 are circumscribed within the indented areas 30 formed by doglegs 28. Locking surfaces 38 engage with the forward edges 80 of lugs 52 which prevents CPA device 12 from being withdrawn from the final position. To withdraw CPA device 12 back to the ready position, legs 24 must be moved inward toward each other a sufficient distance to disengage locking surfaces 38 from forward edges 80 of lugs 52. One way of accomplishing this may be by reaching a tool (not shown) through opening 84 in second connector half 11. Alternatively, locking surfaces 38 may be formed at an oblique angle to legs 24, rather than perpendicular, as shown. Then, a sufficient rearward force would cause disengagement of surface 38 from the forward edges 80 of lugs 52, and enable movement of CPA device 12 back to the ready position.

Additionally, when CPA device 12 is in the final position, latch arm 62 cannot be depressed because CPA latch restraint 40 is located directly under the latch arm 62 and finger pad 66, as illustrated in FIG. 7*b*. Latch engagement surface 42 on latch restraint 40 is preferably in direct contact with the underside of latch arm 62 when CPA device 12 is in the final locked position. But latch restraint 40 also may merely be sufficiently close to prevent latch arm 62 from being depressed far enough to release latch projection 70 from aperture 64. It will be apparent that so long as CPA device 12 is in the final locked position, latch arm 62 cannot be depressed, and the connector halves 10, 11 cannot be unlatched.

In addition, it should be understood that alternative latching mechanisms may be substituted for the latching mechanism 60 illustrated in the preferred embodiment. For example, a pivotally mounted latch arm (not shown) may replace latch arm 62, and may include a tooth like latch projection on the end thereof. The projection may enter an aperture formed on the second connector half, and latch restraint 40 may be inserted under the opposite end of the pivotally-mounted arm to prevent its being depressed to unlatch the latching mechanism. The remaining features, such as guide channels 50 and raised lugs 52, would be retained, and CPA device 12 would still function as described above.

From the foregoing it will be apparent that there is provided a novel CPA device 12 and latching mechanism 60 which enables the two connector halves 10, 11 to be securely engaged and latched. The latching mechanism 60 is more compact and lower in profile than many conventional latching systems, enabling the manufacture of smaller connectors. In addition, because CPA device 12 may be mounted on the first connector half 10 at any point during the assembly process, CPA device 12 provides great flexibility in its use. CPA device 12 of the present invention provides a secure and simple means for locking the latching mechanism 60 of the invention. Since CPA device 12 cannot be moved to the full forward position unless the first connector half 10 is properly assembled and latched to the second connector half 11, CPA device 12 provides visual and mechanical assurance of proper connection between connector halves 10, 11 when CPA device 12 is in the final forward position.

Furthermore, CPA device 12 prevents unintentional unlatching of the latch mechanism 60 by preventing latch arm 62 from being depressed far enough to release latch projection 70. Accordingly, CPA device 12 also acts as a lock for securing the connector halves 10, 11 in the latched position. However, CPA device 12 may be removed if desired to enable unlatching of latch mechanism 60 and disconnection of the connector halves 10, 11. Thus, although the present invention has been described in terms of preferred embodiments, it will be apparent that variations and modifications may be made without departing from the true spirit and scope thereof, as set forth in the following claims.

What is claimed:

1. In combination, a first connector half, a second connector half, and a connector position assurance (CPA) device, comprising:

a first connector half having a pair of generally parallel guide channels on the outer surface thereof and at least one raised lug near the end of said guide channels;

a second connector half mateable with said first connector half, said second connector half having at least one disengagement projection; and a CPA device mountable within said guide channels on said first connector half, said CPA device including a planar body and a pair of generally parallel legs extending outward therefrom, at least one of said legs including a stub surface at the distal tip thereof for contacting said at least one raised lug for preventing forward movement of said CPA device, said at least one leg further including a locking surface spaced proximally of said stub surface and an engagement area extending between said stub surface and said locking surface, whereby, when said first connector half is properly assembled to said second connector half, said at least one disengagement projection on said second connector half contacts said engagement area on said at least one leg for disengaging said stub surface from said raised lug so that said stub surface may be moved past said raised lug whereby said locking surface engages into contact with a forward edge of said raised lug to prevent removal of said CPA device such that said CPA device is thereby located in a final locked position indicative of proper assembly of the first connector half with the second connector half.

2. The combination of claim 1 wherein each said leg includes a said stub surface, a said engagement area, and a said locking surface.

3. The combination of claim 1 wherein said engagement area is a generally convexly-curved surface.

4. The combination of claim 1 further including a latch mechanism, said latch mechanism including a latch arm located on the surface of said first connector half, said latch arm being resiliently attached to said first connector half for engagement with a portion of said second connector half to latch said first connector half to said second connector half when said first connector half is properly mated to said second connector half.

5. The combination of claim 4 further including an aperture in said latch arm for receiving a projection located on said second connector half, whereby when said first connector half is assembled to said second connector half, said projection enters said aperture for latching said first connector half to said second connector half.

6. The combination of claim 5 wherein said latch arm has as a reverse cantilever configuration.

7. The combination of claim 4 further including a latch restraint projecting upward from said planar body of said CPA device such that when said CPA device is located in said final position, said latch restraint will prevent movement of said latch arm, thereby preventing unlatching of said latch mechanism.

8. In combination, a first connector half, a second connector half, and a connector position assurance (CPA) device, comprising:

a first connector half having a pair of generally parallel guide channels on the outer surface thereof and a pair of raised lugs located at a distance spaced from the ends said guide channels;

a second connector half mateable with said first connector half, said second connector half having a pair of opposed disengagement projections; and a CPA device mountable within said guide channels on said first connector half, said CPA device including a planar body and a pair of generally parallel legs extending outward therefrom, said legs including a stub surface at the distal tips thereof for contacting said raised lugs for preventing forward movement of said CPA device when said CPA device is mounted in an initial pre-lock position on said first connector half, said legs further including locking surfaces spaced proximally of said stub surfaces and engagement areas extending between said stub surfaces and said locking surfaces, said locking surfaces contacting the ends of said guide channels in the pre-lock position for preventing removal of said CPA device from said first connector half, whereby, when said first connector half is properly assembled to said second connector half, said disengagement projections on said second connector half contact said engagement areas on said legs for disengaging said stub surfaces from said raised lugs so that said stub surfaces may be moved past said raised lugs, whereby said locking surfaces engage in contact with forward edges of said raised lugs to prevent removal of said CPA device such that said CPA device is thereby located in a final locked position indicative of proper assembly of the first connector half with the second connector half.

9. The combination of claim 8 wherein said engagement areas are generally convexly-curved surfaces.

10. The combination of claim 8 further including a latch mechanism, said latch mechanism including a latch arm located on the surface of said first connector half, said latch arm being resiliently attached to said first connector half for engagement with a portion of said second connector half to latch said first connector half to said second connector half when said first connector half is properly mated to said second connector half.

11. The combination of claim 10 further including an aperture in said latch arm for receiving a projection located on said second connector half, whereby when said first connector half is assembled to said second connector half, said projection enters said aperture for latching said first connector half to said second connector half.

12. The combination of claim 11 wherein said latch arm has as a reverse cantilever configuration.

13. The combination of claim 10 further including a latch restraint projecting upward from said planar body of said CPA device such that when said CPA device is located in said final position, said latch restraint will prevent movement of said latch arm, thereby preventing unlatching of said latch mechanism.

14. In combination, a first connector half, a second connector half, and a connector position assurance (CPA) device, comprising:

a first connector half having a pair of generally parallel guide channels aligned in a spaced relationship on the outer surface of said first connector half;

at least one raised lug near an end of at least one of said guide channels;

a second connector half mateable with said first connector half, said second connector half having at least one disengagement projection; and a CPA device mountable within said guide channels on said first connector half, said CPA device including a planar body and a pair of generally parallel legs extending outward therefrom, at least one of said legs including a stub surface at the distal tip thereof, said at least one leg further including a locking surface located proximally of said stub surface and an engagement area extending between said stub surface and said locking surface, whereby, said CPA device may be mounted on said first connector half in an initial pre-lock position in which said stub surface, said engagement area, and said locking surface are retained between said raised lug and the end of said guide channel, and whereby, when said first connector half is properly assembled to said second connector half, said at least one disengagement projection on said second connector half contacts said engagement area on said at least one leg for disengaging said stub surface from said raised lug so that said stub surface may be moved past said raised lug, whereby when said CPA device has been moved forward a predetermined distance, said locking surface engages into contact with a forward edge of said raised lug to prevent removal of said CPA device such that said CPA device is thereby located in a final locked position indicative of proper assembly of the first connector half with the second connector half.

15. The combination of claim 14 wherein each said leg includes a said stub surface, a said engagement area, and a said locking surface.

16. The combination of claim 14 wherein said engagement area is a generally convexly-curved surface.

17. The combination of claim 14 further including a latch mechanism, said latch mechanism including a latch arm located on the surface of said first connector half, said latch arm being resiliently attached to said first connector half for engagement with a portion of said second connector half to latch said first connector half to said second connector half when said first connector half is properly mated to said second connector half.

18. The combination of claim 17 further including an aperture in said latch arm for receiving a projection located on said second connector half, whereby when said first connector half is assembled to said second connector half, said projection enters said aperture for latching said first connector half to said second connector half.

19. The combination of claim 18 wherein said latch arm has as a reverse cantilever configuration.

20. The combination of claim 17 further including a latch restraint projecting upward from said planar body of said CPA device such that when said CPA device is located in said final position, said latch restraint will prevent movement of said latch arm, thereby preventing unlatching of said latch mechanism.

* * * * *